United States Patent [19]

Janhonen

[11] 4,325,507

[45] Apr. 20, 1982

[54] PACKAGE CARTON AND PROCEDURE FOR ITS MANUFACTURE

[76] Inventor: Veikko I. Janhonen, Långvik, Jorvas, 02420 Kirkkonummi, Finland

[21] Appl. No.: 180,985

[22] Filed: Aug. 25, 1980

[51] Int. Cl.[3] ..... B65D 33/02

[52] U.S. Cl. ..... 229/55; 206/309; 229/68 R

[58] Field of Search ..... 229/55, 68 R; 206/309, 206/312, 313

[56] References Cited

U.S. PATENT DOCUMENTS

| | | | |
|---|---|---|---|
| 2,364,886 | 12/1944 | Wolf | 229/68 R |
| 2,986,325 | 5/1961 | Luderhose | 229/68 R |
| 3,116,005 | 12/1963 | Skaggs | 206/309 |
| 3,344,978 | 10/1967 | Garrod | 229/68 |
| 3,827,552 | 8/1974 | Janhonen | 229/55 |

FOREIGN PATENT DOCUMENTS

| | | | |
|---|---|---|---|
| 2357341 | 5/1974 | Fed. Rep. of Germany | 206/309 |

*Primary Examiner*—Herbert F. Ross

*Attorney, Agent, or Firm*—Jay L. Chaskin

[57] ABSTRACT

The invention relates to a package for books and like flat articles, comprising an inner, double folded carton envelope and an outer protective cover of paper or like thin material closing the edges of the carton envelope. According to the invention each one of the two opposite open edges of the carton envelope is closed by means of two flaps on the protective cover, one of the flaps being folded between the carton envelope and the protective cover, and the other one being folded over the outer side of the protective cover. The third open edge of the carton envelope is closed by means of double folded closing flap formed on the protective cover.

5 Claims, 4 Drawing Figures

Fig. 1
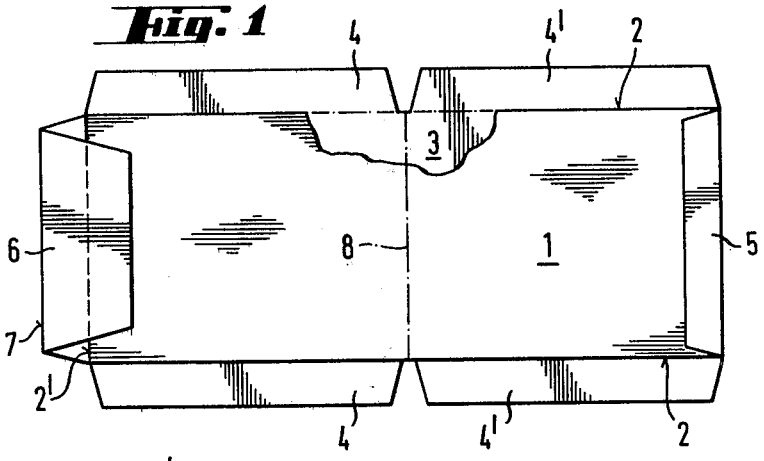
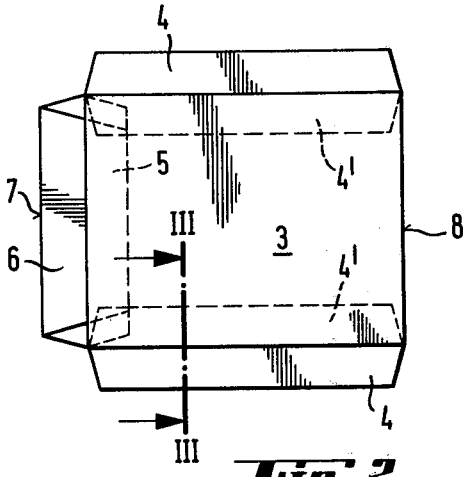
Fig. 2
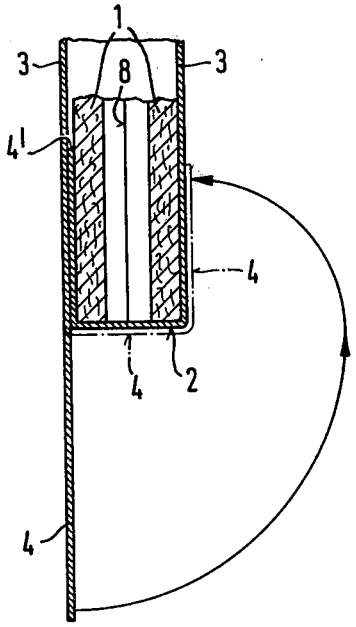
Fig. 3
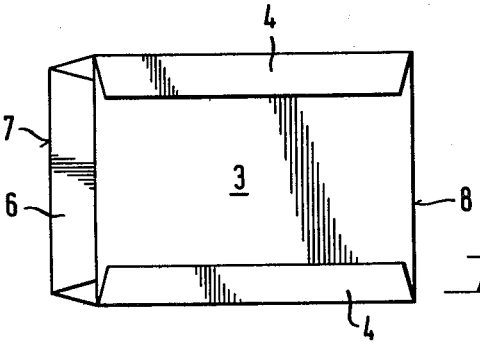
Fig. 4

PACKAGE CARTON AND PROCEDURE FOR ITS MANUFACTURE

FIELD OF THE INVENTION

The present invention concerns a package carton for books, cassettes and equivalent flat goods, comprising an inner supporting cardboard angulated into V shape and a protective wrapper of paper, plastic or equivalent thin material encircling the cardboard and closing the ends of the package.

On a package carton of this type the following requirements are imposed, among others. It should be well protective and tolerate even rough handling. It should be mechanically producible at a high production rate and with low raw material costs. When stored in empty condition, it should require a minimum of space.

SUMMARY OF THE INVENTION

Packages of prior art fail to meet all these requirements well enough, and therefore the object of the invention is to provide an improved package carton in which the above-mentioned, partly conflicting, requirements are optimally satisfied.

This aim is achieved by means of the package of the present invention. The package comprises an inner, double folded cardboard envelope and an outer cover of a thin flexible material having a flap extending along each free edge of said envelope, one of the two flaps along each pair of opposite edges of said envelope adjacent to the back thereof being inserted between the opposite half of said envelope and said cover related thereto and secured to said envelope, and the other one of said flaps being folded over the cover of the opposite half of said envelope and secured thereto.

The double marginal flaps prevent the weakest points of the package, that is the lateral sides, from being torn open. The rectangular supporting cardboards may be cut from a cardboard web without incurring wasted material, and from the protective wrapper only minimal pieces have to be snipped of at the corners of the package.

The invention also relates to a method of producing the above package, said method comprising forming a rectangular sheet of cardboard having a smaller dimension equal to the width of the final package and a larger dimension equal to twice the height of the final package, dividing said sheet of cardboard into two equal halves by making a fold line perpendicularly to said larger dimension, placing said sheet of cardboard on a sheet of thin flexible material, cutting said flexible sheet to a form flaps extending beyond said sheet of cardboard at each free edge thereof in both of said halves, folding said flaps at the edges parallel with said fold line over said sheet of cardboard and securing them to it, folding said sheet of cardboard and said flexible sheet double to form an inner envelope and an outer cover respectively, inserting one of the two flaps along each pair of opposite edges of said envelope adjacent to said fold line between the opposite half of said envelope and its related cover and securing it to said envelope, and folding the other flap over the cover related to the opposite half of said envelope and securing it thereto.

SHORT DESCRIPTION OF THE DRAWING

FIG. 1 shows a package carton according to the invention, in semi-finished condition after cutting out the blanks and affixing them to each other.

FIG. 2 shows the package, nearly completed, before the last marginal flaps are folded.

FIG. 3 shows a section of the package along line III—III of FIG. 2; and

FIG. 4 shows in a planar projection, the completed package carton.

DESCRIPTION OF THE PREFERRED EMBODIMENT

In the following the manufacturing process of the package carton shall be described, whereby at the same time the structure will also be understood. From a storage reel (not depicted) there is pulled a cardboard web having a width substantially twice the height of the package. The web is cut off to lengths equivalent to the width of the package, and these cardboard cut-offs are conducted at a short spacing in upon the paper web and are thereto affixed with a glue substance. Thereafter, the paper web is cut off by a punching operation at the points between cardboards, whereby the paper is left with marginal flaps 4 and 4' projecting past the edges 2 of the cardboard 1. At the same time, pieces are removed from the paper at the corners of the package, as shown in FIG. 1. The paper web has been selected to be greater in width than the cardboard web, whereby the flaps 5 and 6 may be folded around the ends of the cardboard 1 and attached by gluing. In the ultimate package carton, the flap 5, and in its marginal portions also the flap 6, will be located on the inner side of the package's mouth aperture. The cardboard has been positioned to lie closer to one margin of the paper, this enabling the folding line 7 of the flap 6 to be placed at a distance from the terminal edge 2' of the cardboard. The flap 6 may then be employed, in the completed package, as a double closing flap, which is affixable e.g. with glue to the outside marginal surface of the mouth aperture after the goods to be packed have been inserted in the package.

Next, the package is folded double along the line 8, whereby the cardboard 1 remains inside the package in a letter-V position. For closing the sides of the package, this folding step is followed by turning the marginal flaps 4' in between the paper 3 and the carboard 1. This may be accomplished by lifting the paper 3 by its margins off the cardboard. Prior to this, glue substance has been applied to the surface of the flaps 4' which are visible uppermost in FIG. 1, whereby the flaps 4' become adherent to the outer side of the cardboard half to the left of the centreline 8 in FIG. 1. The package is then as illustrated in FIGS. 2 and 3, whereafter all that is needed is to turn the marginal flaps 4 around the lateral sides and affix them, with the glue substance applied to them, to the outer surface of the package (cf. FIG. 3), to obtain a fully completed, empty package carton (FIG. 4).

The purpose of the cardboard 1 is to endow the package with requisite sturdiness and rigidity, and to protect its contents. The paper 3 constitutes a protective wrapper closing the lateral sides of the package and, at the same time, provides for the package a closing flap 6. With the aid of the protective wrapping paper the desired surface quality and appearance can be given to the package, independent of the supporting cardboard 1.

Although the most advantageous materials for the package are cardboard and paper, it is clearly obvious that other similar materials may be used. Since storage reels may be used which have a great width in view of the package size, more material will fit on the same reel diameter; as a consequence, there will be fewer shutdowns of the operations made necessary by reel changing.

Various modifications in function and/or structure may be made by one skilled in the art to the disclosed embodiments without departing from the scope of the invention as defined in the claims.

What I claim is:

1. Package for books, cassettes and equivalent flat goods, comprising an inner, double folded supporting member having front and back portions and secured to an outer cover of a thin flexible material having a flap extending along each free edge of said front and back portion, each of the two flaps along opposite edges of said member adjacent to the back portion thereof being inserted between the front portion of said member and said cover secured thereto and secured to said member front portion, and the other two of said flaps along the opposite edges of said front portion being folded over the cover of the back portion of said member and secured to said cover.

2. Package as in claim 1 wherein, one of the flaps along the end of said member opposite to the back thereof being folded over said member and secured to the inner side thereof, and the other one of said flaps on the opposite end of said member forming a double folded closing flap.

3. Package as in claim 1 wherein the supporting member and the thin flexible material is a paper product.

4. Package as in claims 1 or 2 wherein the flaps are secured by gluing.

5. Package according to claims 1 or 2 wherein the member has a larger dimension substantially equal to twice the height of the package and a smaller dimension substantially equal to the width of the package.

* * * * *